US008091971B2

(12) United States Patent
Ward et al.

(10) Patent No.: US 8,091,971 B2
(45) Date of Patent: Jan. 10, 2012

(54) SOFT CLOSE DRAWER ASSEMBLY

(75) Inventors: Kevin M. Ward, Louisville, KY (US); Michael G. Dobrick, Fisherville, KY (US)

(73) Assignee: Rev-A-Shelf Company, LLC, Jeffersontown, KY (US)

( * ) Notice: Subject to any disclaimer, the term of this patent is extended or adjusted under 35 U.S.C. 154(b) by 817 days.

(21) Appl. No.: 12/132,402

(22) Filed: Jun. 3, 2008

(65) Prior Publication Data

US 2009/0295262 A1 Dec. 3, 2009

(51) Int. Cl.
*A47B 95/00* (2006.01)
*A47B 88/00* (2006.01)

(52) U.S. Cl. ..... 312/333; 312/334.14; 312/334.27; 312/334.44

(58) Field of Classification Search ..... 312/334.44–334.47, 333, 330.1, 319.1, 325, 334.24–334.43, 312/334.14, 334.15, 334.6
See application file for complete search history.

(56) References Cited

U.S. PATENT DOCUMENTS

| | | | | |
|---|---|---|---|---|
| 2,934,390 | A * | 4/1960 | Wright | 312/270.3 |
| 4,575,879 | A | 3/1986 | Cabral et al. | 4/253 |
| 4,720,154 | A * | 1/1988 | Seiter | 312/319.8 |
| 5,201,512 | A | 4/1993 | Rabin | 271/164 |
| 5,409,308 | A | 4/1995 | Reuter et al. | 312/319.4 |
| 5,524,979 | A | 6/1996 | Carson et al. | 312/319.2 |
| 5,634,702 | A * | 6/1997 | Fistonich | 312/270.3 |
| 6,336,692 | B1 | 1/2002 | Snyder | 312/312 |
| 6,553,617 | B1 | 4/2003 | Salice | 16/85 |
| 6,615,450 | B2 | 9/2003 | Salice | 16/85 |
| 6,702,411 | B2 * | 3/2004 | Helver | 312/333 |
| 6,752,478 | B1 | 6/2004 | Francz | 312/334.1 |
| 6,799,663 | B2 | 10/2004 | Dubach | 188/322.22 |
| 6,932,200 | B2 | 8/2005 | Booker et al. | 188/300 |
| 2003/0089565 | A1 | 5/2003 | Salice | 188/283 |
| 2005/0264144 | A1 | 12/2005 | Verbeek et al. | 312/323 |
| 2007/0024166 | A1 * | 2/2007 | Sung | 312/319.9 |

FOREIGN PATENT DOCUMENTS

| | | | |
|---|---|---|---|
| EP | 1635025 | * | 3/2006 |
| EP | 1790251 | A1 | 5/2007 |
| WO | WO 2009/109536 | A1 | 9/2009 |

* cited by examiner

*Primary Examiner* — Darnell Jayne
*Assistant Examiner* — Timothy M Ayres
(74) *Attorney, Agent, or Firm* — Brinks Hofer Gilson & Lione

(57) ABSTRACT

A soft-close cabinet slide assembly permits the soft-close action and/or a soft-open action of a drawer, and thus the reduction of effort by an operator, when the drawer is opening or closing. The cabinet slide assembly includes a cabinet, a drawer, and at least one slide mechanism coupling the drawer to the cabinet to permit movement of the drawer between a fully open position and a fully closed position. A forcing means for exerting an extension force, preferably a gas spring, is also be included in the soft-close cabinet slide assembly having a first end coupled to the cabinet and a second end coupled to the drawer. Preferably, the soft-close cabinet slide assembly also includes a first and second pivotal coupling, which permit the gas spring to swing through an arc as the drawer moves between the fully open position and the fully closed position.

20 Claims, 8 Drawing Sheets

SOFT CLOSE DRAWER ASSEMBLY

BACKGROUND OF THE INVENTION

1. Field of the Invention

The present invention generally relates to drawers that slide in and out of a cabinet, and particularly to mechanisms that control the rate at which a drawer slides into a cabinet such that an abrupt stop of the closing motion of the drawer is avoided when it arrives at a fully closed position, and at which a drawer slides away from a cabinet such that an abrupt stop of the opening motion of the drawer is avoided when it arrives at a fully open position.

2. Description of the Prior Art

There are presently available a number of rate controlling mechanisms, both damping and springing mechanisms, that are provided with a drawer or lid of cabinets. Some of the simpler mechanisms include rubber or foam bumpers between the face of the cabinet and the drawer or slide mechanism. Though the bumpers soften the impact of the drawer as the drawer closes, the bumpers are not optimal for heavy or fast moving drawers and not an effective for the abrupt stops.

Other mechanisms include a springing mechanism located proximate the drawer or lid. For example, in U.S. Pat. No. 5,409,308 to Reuter et al., a cabinet is provided with a curved, upward-swinging door with an opening mechanism including a pair of opposed pivot arms, each pivotably connected to a gas spring, which is connected to the end walls of a cabinet. Each pivot arm includes a circular disk portion integrally formed with a tangential arm and a mounting bracket for mounting each pivot arm to door. The rod of the gas spring preferably faces downwardly and the cylinder end preferably faces upwardly, to keep the oil in the cylinder. When opening the door, each arm rotates around a central boss of the circular disk causing the gas spring to generate a force tangential to the rotatably mounted circular disk. The force of the gas spring causes the door to continue to move open. However, the primary motion of the door is swinging, rather than sliding, and the use of a complexly designed arm is necessary to bear the load of the door and the force of the gas spring when swinging open and closed.

Yet, other springing mechanisms are available for drawers that slide. Generally, these mechanisms are integrated with the rails in a complicated manner that often do not allow for minimal modifications to conventional drawer-slide rail systems. Furthermore, many of the slide mechanisms only provide for a soft-close action but do not address both the soft-close action and the soft-open action. One example is U.S. Pat. No. 6,752,478 to Francz, which shows a damping mechanism, preferably a slide and a damper, borne on the pull-out rail toward the front of the drawer and parallel to the sides of a drawer. The damping mechanism travels with the movement of the pull-out rail, and remains inoperative until when the drawer is closing, an abutment presses against the plunger. The abutment presses against the plunger of the damping mechanism, pushing the piston into the cylinder, which causes damping of the drawer and prevents a front panel from striking against the body side walls with a great force. A pull-in device arranged at the rear of a support rail can also be included to couple a central rail, which runs between the pull-out rail and the support rail. The pull-in device pulls the central rail, together with the pull-out rail, further into the furniture carcass, with this movement being dampened by the damping mechanism and consequently providing only a soft-close action.

Thus, there remains a need for a drawer and slide mechanism that allows the drawer to fully close or fully open gradually without an abrupt stop, that is, providing a soft-close action and a soft-open action. There also remains a need to integrate such drawer and slide mechanism with conventional drawer slide systems in a simpler manner.

SUMMARY OF THE INVENTION

In one embodiment of the present invention, a soft-close cabinet slide assembly can include a cabinet, a drawer, and at least one slide mechanism coupling the drawer to the cabinet to permit movement of the drawer between a fully open position and a fully closed position. A gas spring can also be included in the soft-close cabinet slide assembly having a first end coupled to the cabinet and a second end coupled to the drawer. The gas spring is preferably situated to facilitate a reduction of speed of the drawer as the drawer approaches the fully closed position or the fully open position. Preferably, the soft-close cabinet slide assembly also includes a first pivotal coupling at the first end of the gas spring and a second pivotal coupling at the second end of the gas spring. The pivotal couplings can permit the gas spring to swing through an arc as the drawer moves between the fully open position and the fully closed position. When the drawer moves through the middle position, the gas spring can achieve a compressed position. The gas spring can achieve an extended position, when the drawer moves to the fully open and fully closed positions. An operator can also exert an external force to the drawer to move the drawer passed the middle position, when such external force can be removed, allowing the drawer to move through the middle position.

In another embodiment of the present invention, the soft-close cabinet slide assembly can include a cabinet for receiving a drawer, with the drawer having a front end, a rear end, and a middle region in between the front and rear ends. The soft-close cabinet slide assembly can also include at least one slide mechanism coupling the drawer to the cabinet to permit movement of the drawer through a middle position between a fully open position and a fully closed position. A forcing means for exerting an extension force can also be included in the soft-close cabinet slide assembly. The forcing means can include a mechanical spring, a gas spring, a gas spring with a damper, or other equivalents. The forcing means can have a first end coupled proximate the front of the cabinet and a second end coupled to the middle region of the drawer. The forcing means can be movable between an extension position and a compressed position, with the forcing means being situated to facilitate a reduction of speed of the drawer as the drawer approaches the fully closed position. The forcing means preferably achieves the compressed position when the drawer is at the middle position, and achieves the extension position when the drawer is at either the fully open position or the fully closed position. The drawer preferably moves passed the middle position from either the fully open position or the fully closed position by an external force.

One feature of the soft-close cabinet slide assembly of the present invention is the soft-close action of the drawer, and thus the reduction of effort by an operator, when the drawer is closing. Another feature of the soft-close cabinet slide assembly of the present invention is the soft-open action of the drawer, and thus the reduction of effort by an operator, when the drawer is opening. Yet, another feature is the simple manner by which the soft-close cabinet slide assembly achieves the soft-close action, the soft-open action, or both. For instance, as the drawer leaves the middle position, the forcing means or the gas of the gas spring exerts an extension force on the drawer to cause the drawer to accelerate with an increase in speed to either the fully closed position or the fully open position. As the piston and rod of the gas spring approaches a fully extended position, the piston contacts oil within the cylinder. The oil is forced to pass through an orifice in the piston, thereby causing the drawer to decelerate to perform the soft-close action, the soft-open action, or both, as the drawer moves relative to the cabinet.

Other features and advantages of the present invention will become apparent to those skilled in the art from the following disclosure of preferred embodiments of the present invention exemplifying the best mode of practicing the invention. The following disclosure references the accompanying drawings illustrating the preferred embodiments.

DESCRIPTION OF PREFERRED EMBODIMENTS

Figure 1:
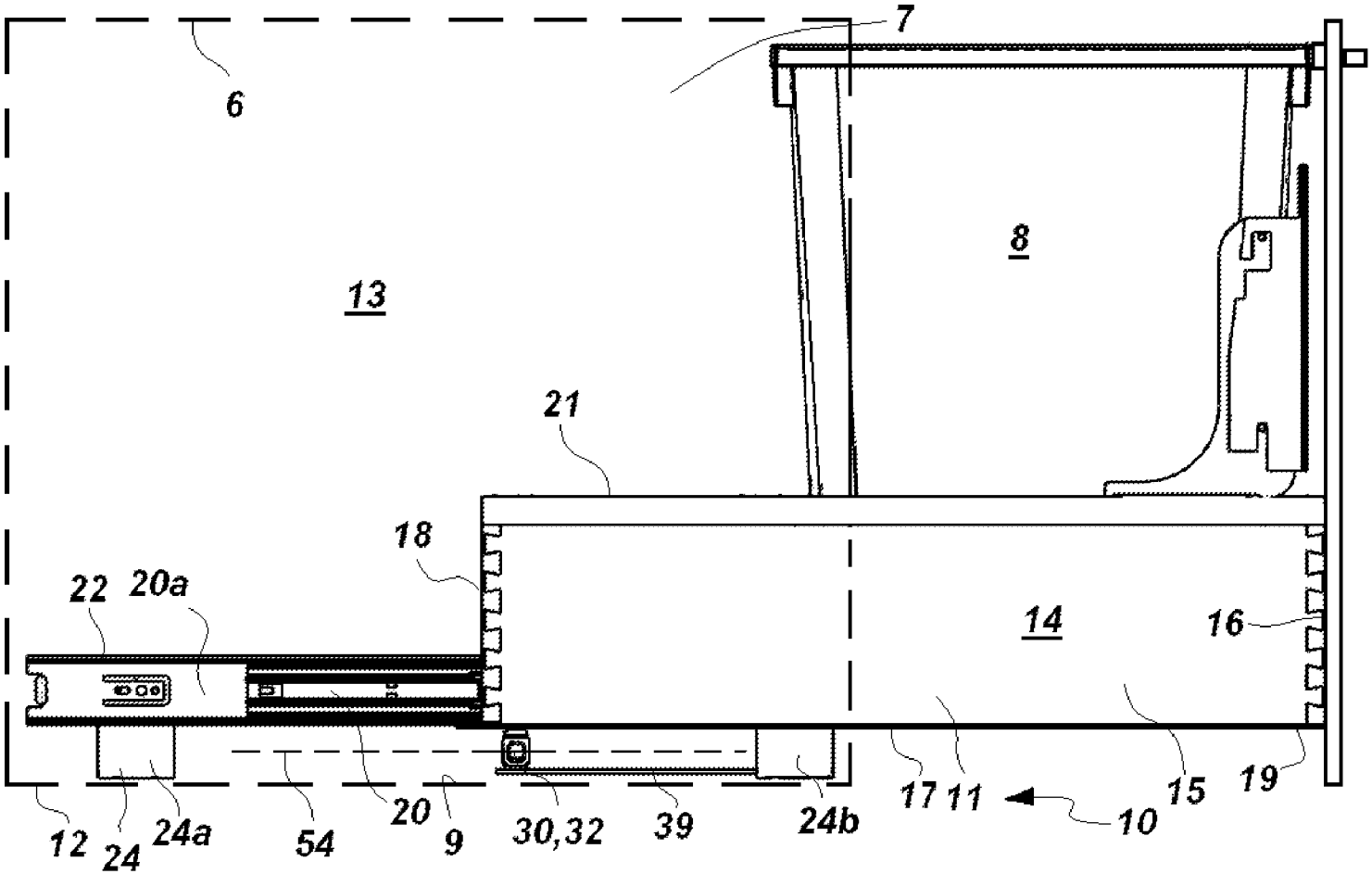
FIG. 1 is a side view of a soft-close cabinet slide assembly, including a cabinet, a drawer, a slide mechanism, and a load depicted as a wastebasket.

Referring to the drawings, where like reference numerals are used throughout the various views to designate like components, and more particularly to FIG. 1 thereof, an soft-close cabinet slide assembly 10 is depicted for allowing a drawer 14 to close or open softly relative to a cabinet 12 or an enclosure (represented by the dashed box), which receives the drawer 14 without an abrupt stop. It is to be understood that the cabinet 12 or the enclosure may be a kitchen or bathroom cabinet, a paper file cabinet, a tool chest, an industrial or consumer storage cabinet, or any of a variety of enclosures used for housing any of a variety of objects. The cabinet 12 incorporates a floor 9, a roof 6 and side walls 7. The drawer 14 generally includes a cubical body 15 with a front end panel 16 that faces away from a cabinet interior 13, a rear end panel 18 that faces toward the cabinet interior 13, and a middle region 17 positioned between the drawer front end and rear end panels 16, 18. The drawer 14 also generally includes a bottom panel 19 that faces the cabinet floor 9 and side panels 11 each having a top end 21 that faces the roof 6 of the cabinet 12. The drawer 14 may be a solid piece of wood, a composite structure comprising a variety of materials, or may be of frame and panel construction. The drawer 14 is configured for receiving a load 8 of contents, for example, in FIG. 1 the load 8 is a wastebasket, or any other desired utility device. Examples of such utility devices may include a cutlery station, a lazy susan, a pot or pan holder, a wine rack, a paper file organizer, a tool or appliance holder or storage compartment, or any other such item that a typical homeowner or business operator may wish to have slide out access to in a cabinet or another similar such enclosure.

Figure 2:
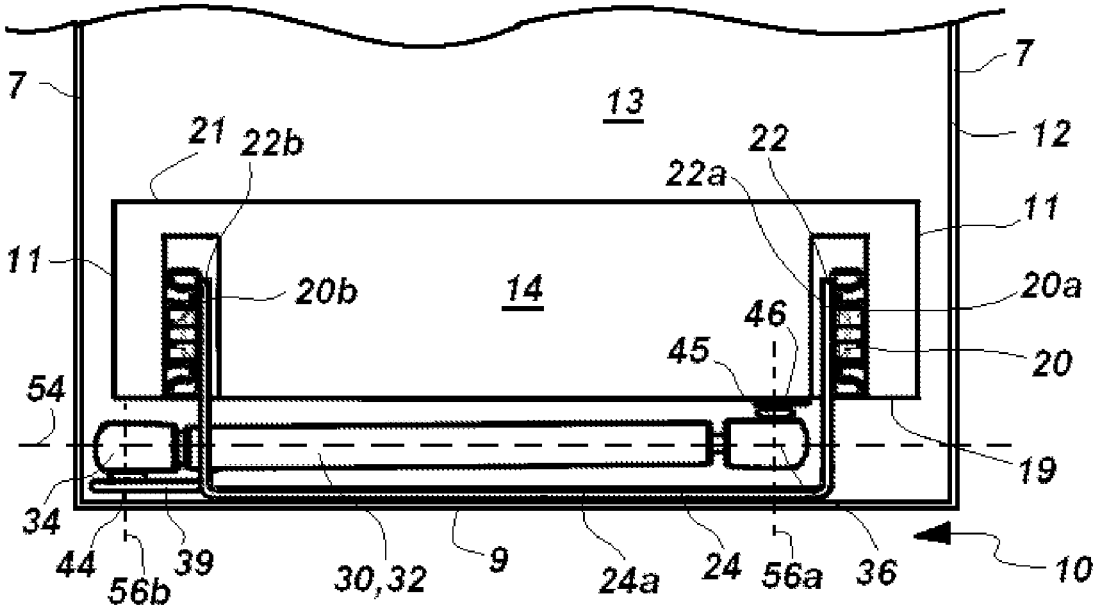
FIG. 2 is an end view of the soft-close cabinet slide assembly of FIG. 1.

According to FIG. 2, the drawer 14 slides in and out of the interior 13 of the cabinet 12 by at least one slide mechanism 20, which attaches to a portion of the drawer 14. Another portion of the slide mechanism 20 can attach to an adjacent supporting member 22 that is attached to the cabinet 12 by an attachment mount 24. The conventional drawer slide mechanism 20 can include a left drawer slide rail 20*a* and a right drawer slide rail 20*b* that are installed into the cabinet 12. Here, a portion of the left and right drawer slide rails 20*a*, 20*b* can attach to the side panels 11 of the drawer 14, while another portion of the left and right drawer slide rails 20*a*, 20*b* can attach to the adjacent supporting members 22*a*, 22*b*. The adjacent supporting member 22*a*, 22*b* can be attached to the cabinet 12 by a rear attachment mount 24*a* and a forward attachment mount 24*b*. The slide mechanism 20 preferably is parallel with the side walls 7 of the cabinet 12, while the attachment mount 24 preferably is perpendicular to the sides 7 of the cabinet 12.

Figure 3:
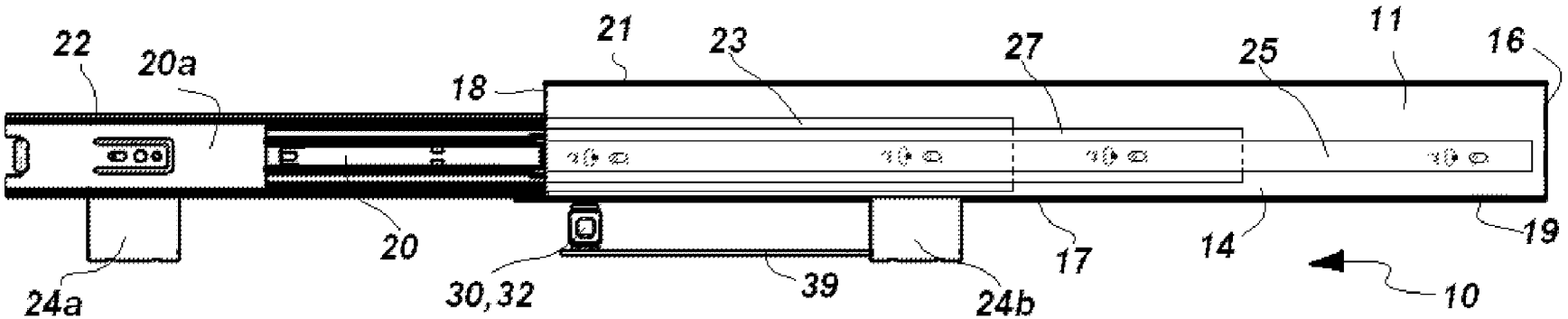
FIG. 3 is a side view of a soft-close cabinet slide assembly, depicting a slide mechanism in more detail.

Referring to FIG. 3, each slide mechanism 20 can include a fixed cabinet support rail 23 and a fixed drawer support rail 25. The fixed cabinet support rail 23 can be permanently attached to the adjacent supporting member 22 adjacent to the side panel 11 of the drawer 14. The fixed drawer support rail 25 can be permanently attached to the side panel 11 of the drawer 14 adjacent to the side wall 7 of the cabinet 12. Each slide mechanism 20 can also include a sliding intermediate rail 27 slidably affixed to both the fixed cabinet support rail 23 and the fixed drawer support rail 25 and securably engaged to permit only sliding movement. While the cabinet 12 is intended to remain stationary, the drawer 14 is permitted to move between a fully open position 26 with the drawer 14 substantially outside of the cabinet 12 (see FIG. 4*b*) and a fully closed position 28 with the drawer 14 substantially within the cabinet interior 13 (see FIG. 4*c*). As the drawer 14 is moving to the fully open position 26, the sliding intermediate rail 27 is sliding upon the fixed cabinet support rail 23, thereby causing the drawer support rail 25 to slide upon the sliding intermediate rail 27. The load 8 of the drawer 14, and between the rails 23, 25, 27, is conventionally transmitted by way of ball bearing slides. Optionally, rollers, preferably rollers in a running carriage, and/or gliding or sliding means can be used. It is to be appreciated that the slide mechanism 20 can include any configuration of railing or drawer sliding mechanism known in the art.

Figure 4A:
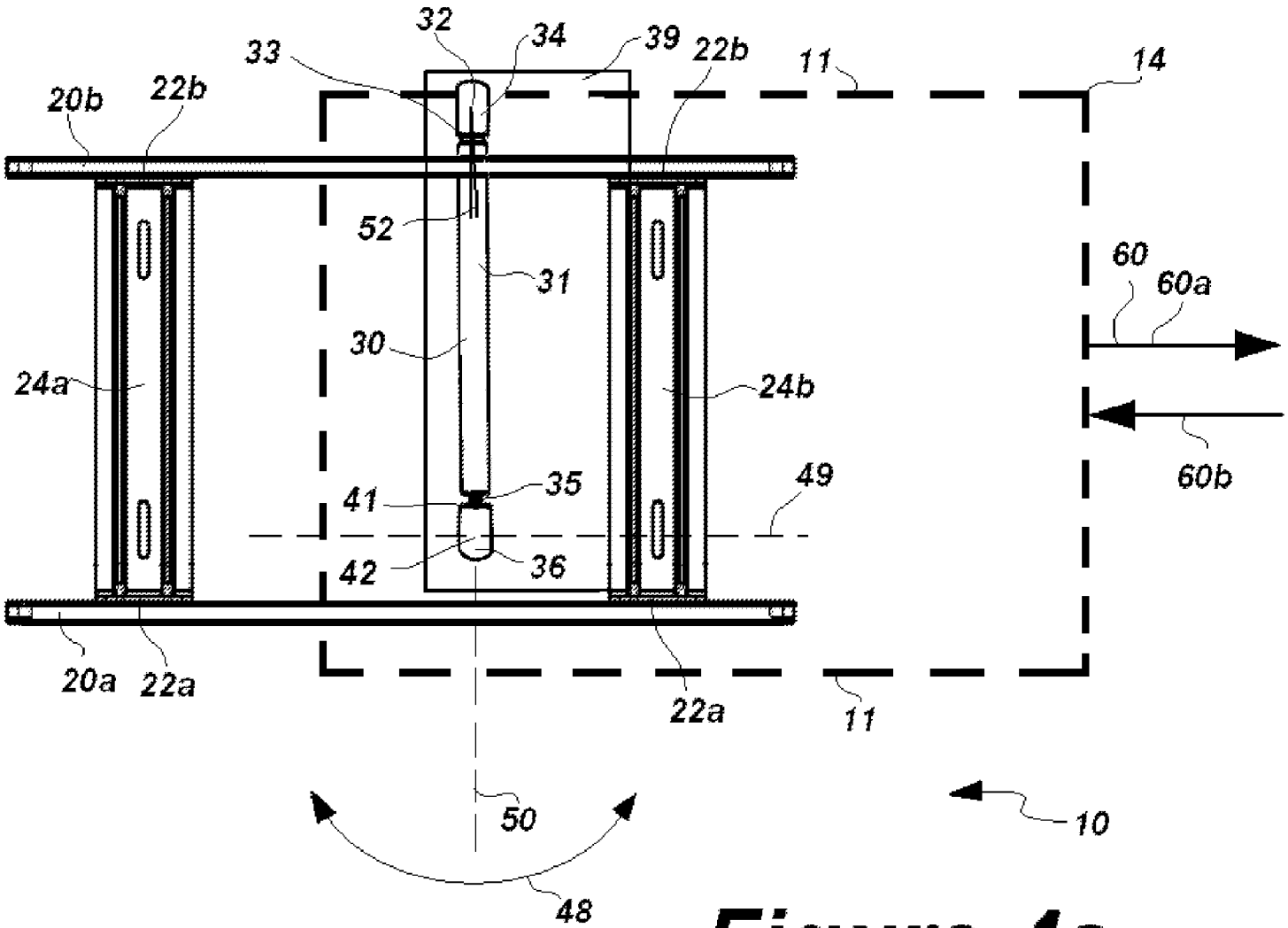
FIG. 4*a* is a top view of a soft-close cabinet slide assembly shown without a cabinet, depicting a gas spring and a drawer at a middle position.
Figure 4B:
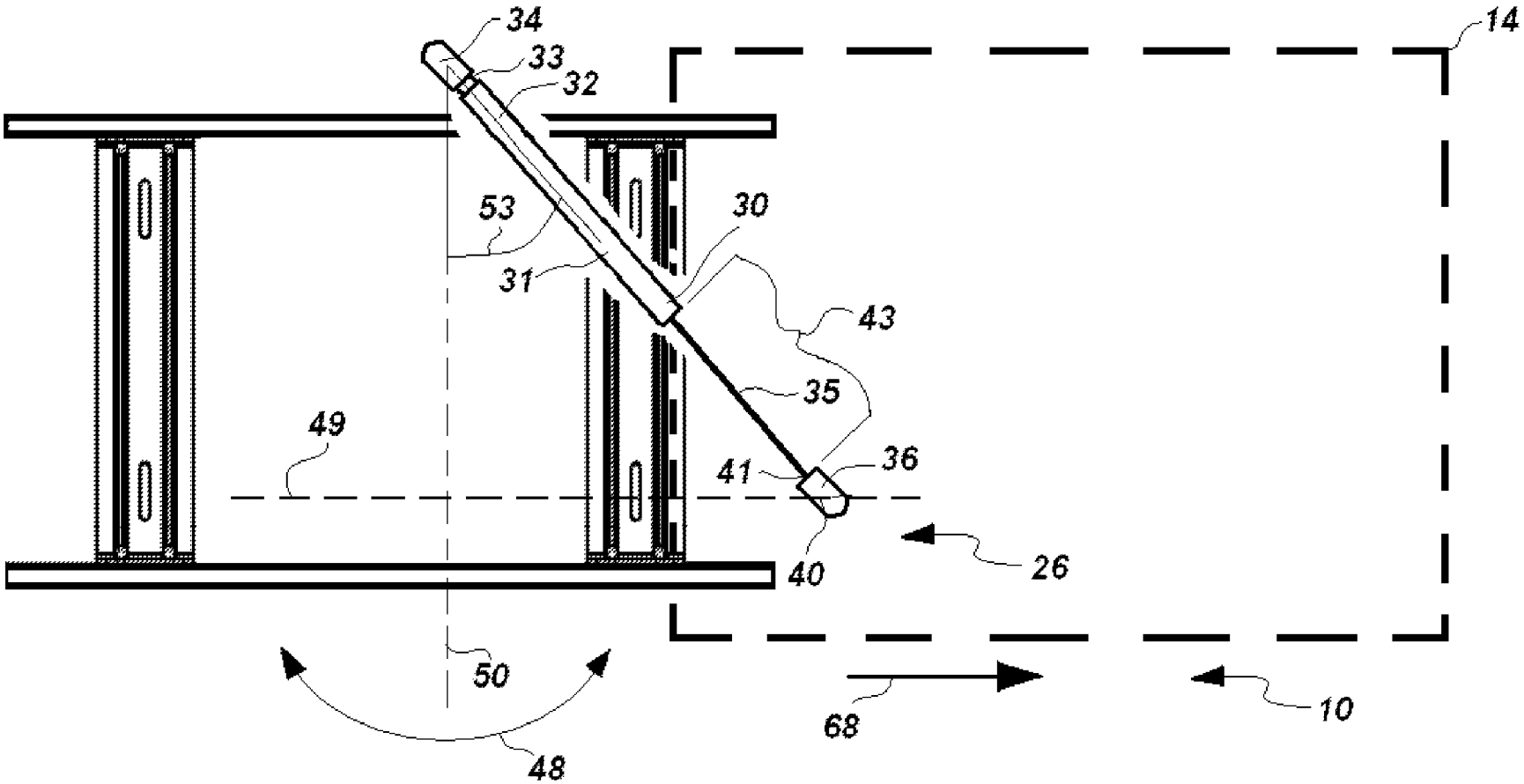
FIG. 4*b* is a top view of a soft-close cabinet slide assembly shown without a cabinet, depicting a gas spring and a drawer at a fully open position.
Figure 4C:
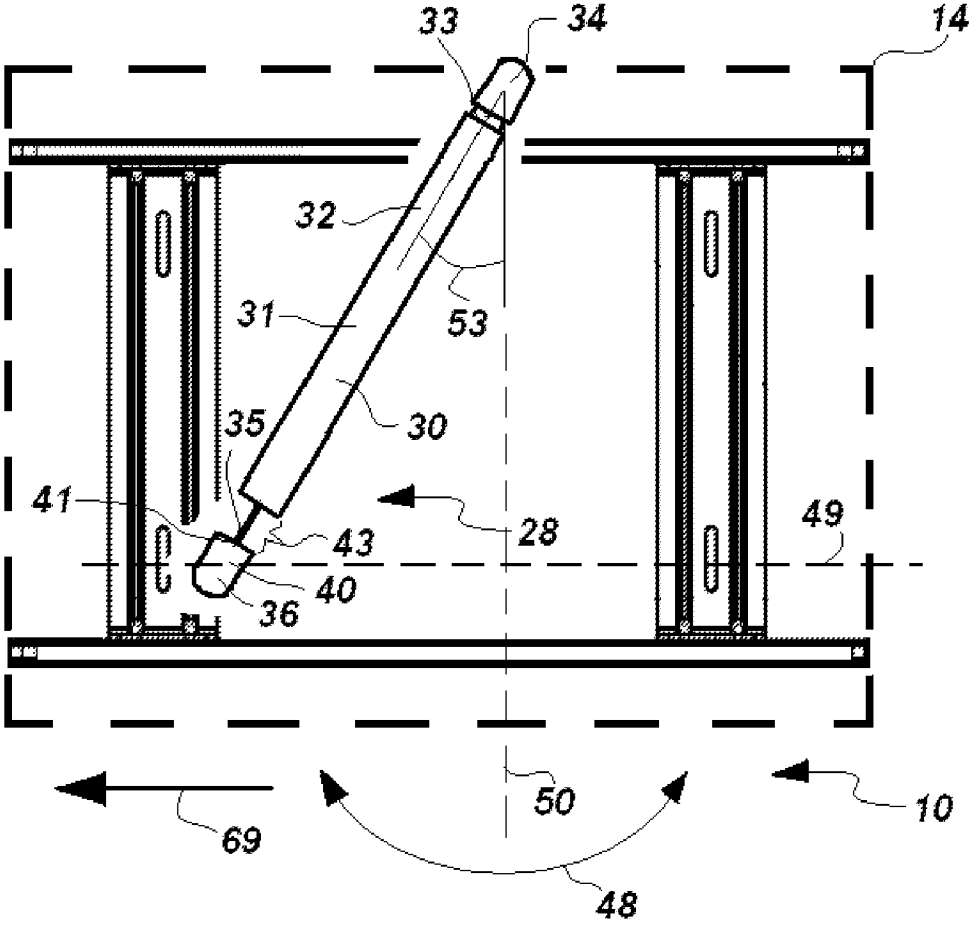
FIG. 4*c* is a top view of a soft-close cabinet slide assembly shown without a cabinet, depicting a gas spring and a drawer at a fully closed position.

The soft-close cabinet slide assembly 10 also includes a forcing means 30 for exerting an extension force. The forcing means 30 can include: a mechanical spring, a gas spring that provides a controlled extension force with or without a damper, or other equivalents known in the art. A preferred embodiment of the present invention includes a gas spring 32. Referring to FIGS. 4*a*, 4*b* and 4*c*, the gas spring 32 can include a cylindrical tube 31 provided with a reciprocating piston (not shown) or plunger and a piston rod 35. An extended length (not shown) of the gas spring 32, which is the distance between a cylindrical tube end 33 and a piston rod end 41 when fully extended, can infinitely vary. A typical extended length can be between about 5.0 inches and about 35.5 inches; preferably, between about 5.0 inches and 10 inches. Also shown in FIG. 4*b*, a stroke length 43, which is measured as the total distance the piston rod end 41 travels between the fully open position 26 to the fully closed position 28, can be about 0 percent to about 50 percent of the extended length 37; preferably, about 30 percent to about 40 percent.

Figure 6:
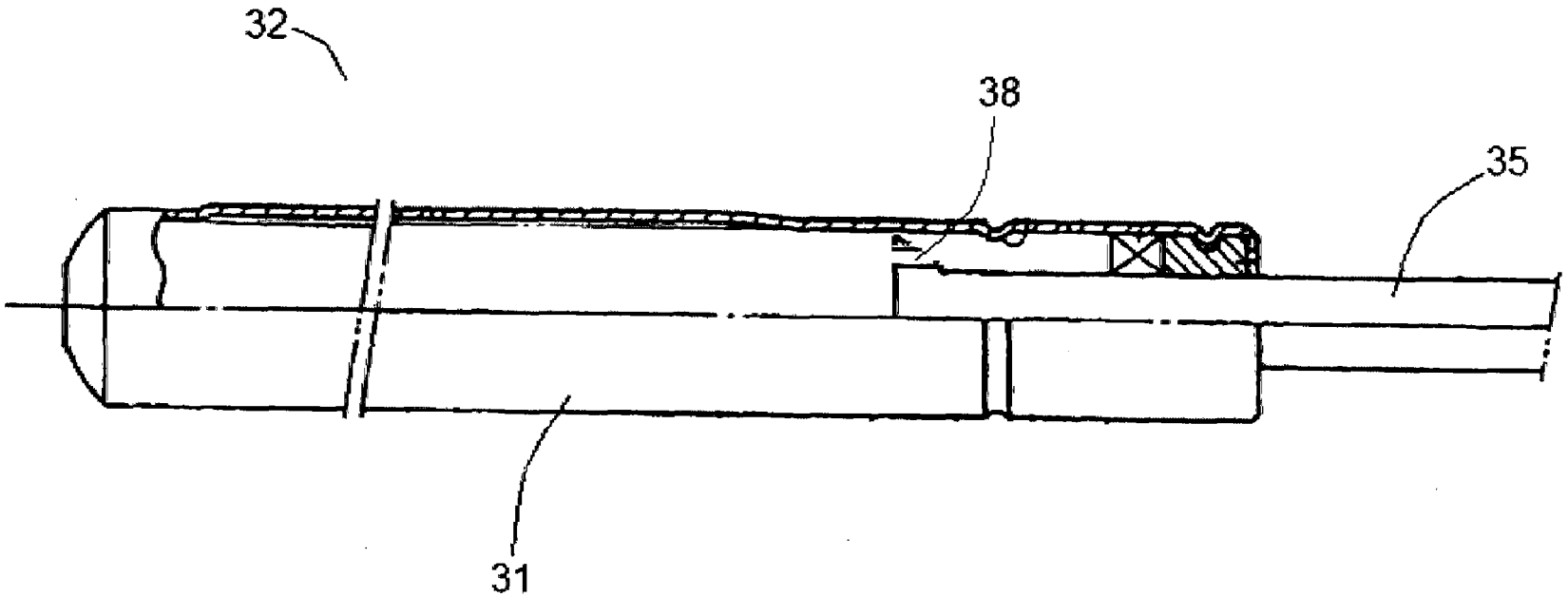
FIG. 6 is a cross sectional view of one example of a gas spring.

High pressure gas, typically nitrogen, air, fluid or oil can be within the cylindrical tube 31 to provide the proper stroke pressure within the gas spring 32. It can be appreciated that the specifications of the gas spring 32 for any given size and weight of the drawer 14 and the load 8 can be calculated in the manner known in the art. The typical exerting force or stroke pressure of a gas spring 32 can be between about 0 pounds (force) per square-inch (psi) to about 250 psi; preferably, about 2 psi to 10 psi. The gas spring 32 can also include a damping means 38 as shown in FIG. 6, such as a dashpot or damper. The damping means 38 can resist the motion of the drawer 14 by absorbing a force that is proportional to the velocity of the sliding drawer 14. The damping means 38 preferably acts in the opposite direction of the sliding drawer 14, slowing the motion and absorbing energy of the drawer 14 and the load 8.

Referring to FIGS. 2 and 4*a*, the gas spring 32 can have a first end 34 coupled to the cabinet 12 and a second end 36 coupled to the drawer 14. FIG. 4*a* illustrates the cylindrical tube end 33 proximate the first end 34 and the rod end 41 proximate the second end 36. Alternatively, the cylindrical tube end 33 can be located proximate the second end 36 and the rod end 41 proximate the first end 34. The soft-close cabinet slide assembly 10 can also include a first pivotal coupling 44 at the first end 34 of the gas spring 32 coupled to proximate the front end panel 16 of the cabinet 12 at a mounting plate 39. In addition, the soft-close cabinet slide assembly 10 can include a second pivotal coupling 46 at the second end 36 of the gas spring 32 coupled to the middle region 17 of the drawer 14 at an attachment plate 45. The mounting plate 39 is preferably positioned parallel and affixed to the floor 9 of the cabinet interior 13 and adapted to receive the fixed mounting bracket of the first pivotal coupling 44, while the attachment plate 45 is preferably positioned parallel and affixed to the bottom panel 19 of the drawer 14 and adapted to receive the fixed mounting bracket of the second pivotal coupling 46. The pivotal couplings 44, 46 are configured to permit the gas spring 32 to swing through an arc 48 as the drawer 14 moves between the fully open position 26 and the fully closed position 28. Preferably, the first end 34 coupled to the cabinet 12 remains stationary, and the second end 36 attached to the drawer 14 translates with the sliding drawer 14 along a substantially linear path 49. The second end 36 or the second pivotal coupling 46 can translate outside the cabinet 12 when the drawer 14 is at the fully open position 26; preferably, the second end 36 remains inside the cabinet 12. The gas spring 32 can be situated to facilitate a reduction of speed of the drawer 14 when approaching either the fully open or closed positions 26, 28.

The gas spring 32 can move between an extension position 40 and a compressed position 42. The extension position 40 can be when the rod 35 is at 100 percent extension, or fully extended, or less than 100 percent extension. The compressed position 42 can be when the rod 35 is at 100 percent compression, or fully retracted, or less than 100 percent compression. In other words, the rod 35 need not be fully extended to reach the extension position 40, and the rod 35 need not be fully compressed to reach the compressed position 42. When the gas spring 32 achieves the compressed position 42, the drawer 14 can be moving through a middle position 50, as illustrated in FIG. 4*a*, which is at a location between the fully open position 26 and the fully closed position 28 of the drawer 14. The gas spring 32 is preferably substantially perpendicular to the slide mechanism 20 when the drawer 14 is at the middle position 50, that is, when an angle 52 is about 0 degrees. However, the gas spring 32 can be at the angle 52 of plus or minus 20 degrees when the drawer 14 is at the middle position 50.

When the gas spring 32 achieves the extension position 40, or being less compressed than the compressed position 42, the drawer 14 can be positioned at either the fully open position 26 (see FIG. 4*b*) or the fully closed position 28 (see FIG. 4*c*). The gas spring 32 can be at an angle 53 in the range of about 20 degrees to about 60 degrees when the drawer 14 is at the fully open position 26 or the fully closed position 28. The first end 34 and the second end 36 of the gas spring 32 can be positioned such that the change in gas spring compression is maximized as the drawer 14 approaches either the fully open 26 or the fully closed position 28.

The gas spring 32 can be located anywhere on the drawer 14 or cabinet 12 as appreciated by those of ordinary skill in the art. According to FIG. 2, the gas spring 32 is preferably located in a space between drawer bottom panel 19 and cabinet floor 9 substantially parallel to the drawer bottom panel 19 and cabinet floor 9. Here, the gas spring 32 can operate in a plane 54 substantially parallel to the drawer bottom panel 19 and cabinet floor 9, transversing the sides 7, 11 of the cabinet 12 and drawer 14 while operating. Thus, each of the first and second ends 34, 36 or the pivotal couplings 44, 46 can pivot about a vertical axis 56*a*, 56*b* that is substantially perpendicular to the operative plane 54 of the gas spring 32. Optionally, the gas spring 32 can be in a vertical configuration, located on the sides 7, 11 of the drawer 14 and the cabinet 12, and operate in a similar fashion described herein.

In general, an operator of one of the embodiments of the soft-close cabinet slide assembly 10 can apply an external force 60 on the drawer 14 to place the drawer 14 in either the fully open position 26 or the fully closed position 28. Referring to FIGS. 4*a*, 4*b* and 4*c*, to open the drawer 14 to the fully open position 26 from the fully closed position 28, the operator can apply the external force 60*a* to a handle on the front end panel 16 of the drawer 14, or to the drawer 14 directly, and pull with sufficient force to overcome the extension force of the gas spring 32 in order to move the drawer toward the outside of the cabinet 12, represented by arrow 68. Preferably, the external force 60*a* is applied until the drawer 14 moves through the middle position 50, after which the external force 60*a* can be removed from the drawer 14. To close the drawer 14 to the fully closed position 28 from the fully open position 26, the operator can apply the external force 60*b* to a handle on the front end panel 16 of the drawer 14, or to the drawer 14 directly, and push with sufficient force to overcome the extension force of the gas spring 32 to move the drawer 14 toward the interior 13 of the cabinet 12, represented by arrow 69. Preferably, the external force 60*b* is applied until the drawer 14 moves through the middle position 50, after which the external force 60*b* can be removed from the drawer 14.

Figure 5:
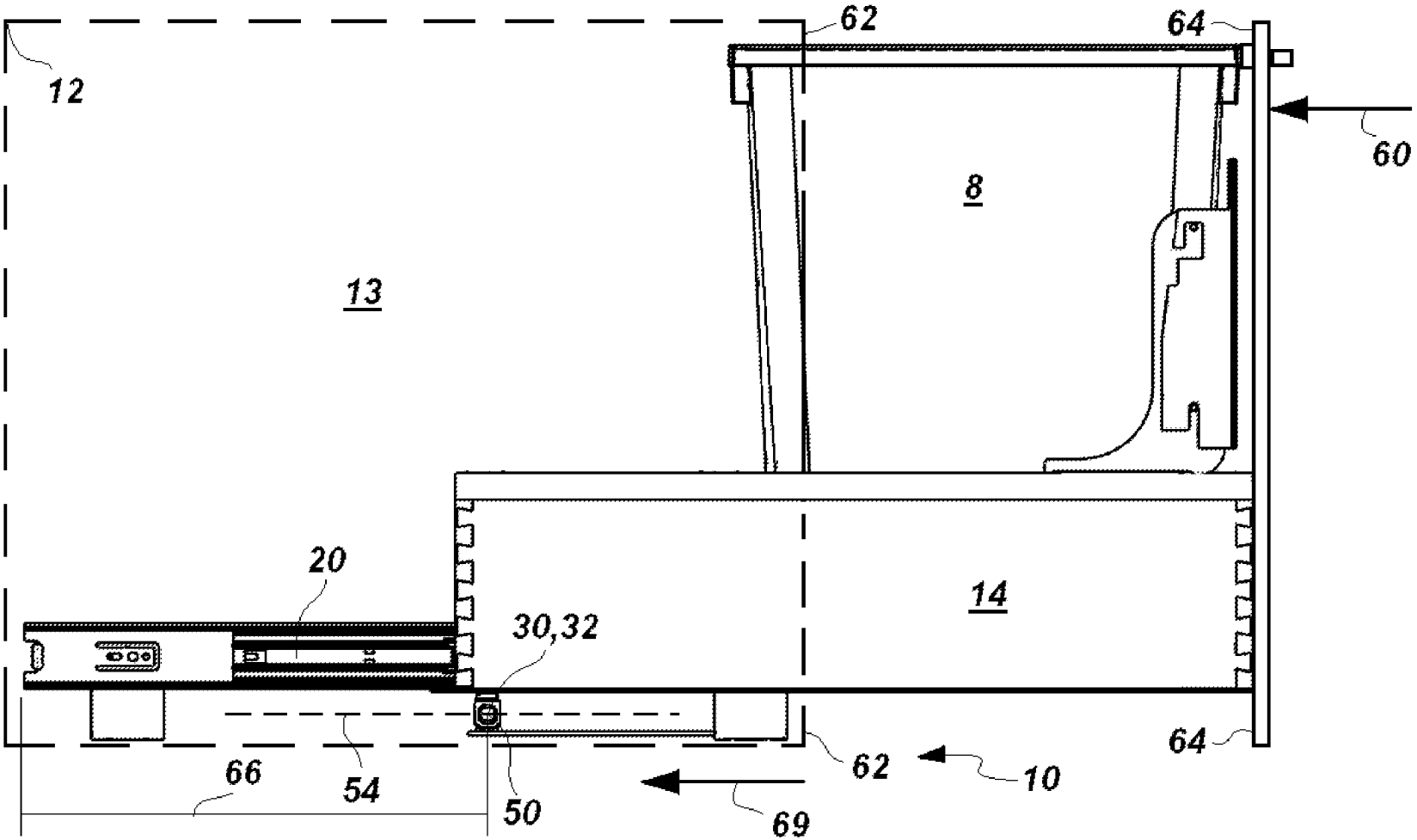
FIG. 5 is a side view of a soft-close cabinet slide assembly, including a cabinet, a drawer, a slide mechanism, and a load illustrated as a wastebasket, all depicting a soft-close action.

Referring to FIG. 5, the soft-close action of the drawer 14, and thus the reduction of effort by an operator, is illustrated with the following. As the drawer 14 approaches the middle position 50 from either the fully closed position 28 or fully open position 26, the drawer 14 and load 8 exert a compressive force on the piston and rod 35, which have a tendency to exert an extension force because of the gas, preferably nitrogen, in the gas spring 32. As a result, the piston and rod 35 of the gas spring 32 approaches the compressed position 42 or the fully retracted position, where the piston contacts oil within the cylinder, causing the oil to pass through an orifice in the piston. Thus, the drawer 14 experiences a reduction of speed, or decelerates, until the drawer 14 reaches the middle position 60.

As the drawer 14 leaves the middle position 50 to approach the fully closed position 28 or fully open position 26, the piston and rod 35 of the gas spring 32, because of the force of the gas, exert an extension force on the drawer 14 and load 8, which causes the drawer 14 to accelerate with an increase in speed. As a result, the piston and rod 35 of the gas spring 32 approaches the extension position 40 or a fully extended position, where the piston contacts oil within the cylindrical tube 31, causing the oil to pass through the orifice in the piston. Thus, the drawer 14 experiences a reduction of speed, or decelerates, and gives a soft-open action when the drawer 14 is at the fully open position 26 and/or a soft-close action when the drawer 14 is at the fully closed position 28.

Alternatively, as the drawer 14 is experiencing an increase in acceleration, the drawer 14 can be prevented from moving passed the fully open position 26 and/or the fully closed position 28 by physical stops positioned on the slide mechanism 20 and/or drawer 14. For example, the face 62 of the cabinet 12 can engage the overhang 64 of the face of the drawer 14 to stop the drawer 14. Here, the area 66 of movement of the drawer 14 between the middle position 50 and the fully closed position 28 is small enough, where the soft-close action is executed by the slower acceleration of the drawer 14 moving toward the interior 13 of the cabinet 12, represented by arrow 69. The drawer 14 can also experience a slower acceleration to execute the soft-open action as the drawer 14 moves away from the interior 13 of the cabinet 12. The soft-close cabinet slide assembly 10 can perform only the soft-close action or only the soft-open action, or can perform both the soft-close action and the soft-open action.

From the forgoing description of the structure and operation of a preferred embodiment of the present invention, it will be apparent to those skilled in the art that the present invention is susceptible to numerous modifications and embodiments within the ability of those skilled in the art and without exercise of the inventive facility. Accordingly, the scope of the present invention is defined as set forth of the following claims.

What is claimed is:

1. A cabinet slide assembly comprising:

a cabinet comprising a floor, a roof, and a pair of side walls;

a drawer comprising a front panel, a rear panel, a pair of side panels coupling the front and rear panels, and a bottom panel attached to the front and rear panels, each side panel having an inner surface, the inner surfaces of the side panels facing one another;

at least one slide mechanism coupling the drawer to the cabinet and situated to permit movement of the drawer between a fully open position and a fully closed position, and through an intermediate position located therebetween, relative to the cabinet, the slide mechanism comprising at least two drawer support rails, one drawer support rail coupled to the inner surface of each of the drawer side panels; and a gas spring having a first end coupled to a portion of at least one of the cabinet and the slide mechanism, and a second end coupled to a portion of the drawer, the gas spring capable of swinging through an arc about the first end, with the second end being movable with the movement of the drawer;

wherein the gas spring is disposed within a space defined by the cabinet floor and the drawer bottom panel and swings along a substantially horizontal plane about the first end thereof.

2. The assembly of claim 1, wherein the gas spring is adapted to facilitate a reduction of speed of the drawer as the drawer approaches at least one of the fully closed position and the fully open position.

3. The assembly of claim 2, wherein the gas spring comprises a damper.

4. The assembly of claim 1, wherein the gas spring is self-extendable from a compressed position to an extension position.

5. The assembly of claim 4, wherein the gas spring is in the compressed position upon movement of the drawer through the intermediate position.

6. The assembly of claim 4, wherein the gas spring is in the extension position when the drawer is located in at least one of the fully open position and the fully closed position.

7. The assembly of claim 1, wherein the gas spring is substantially perpendicular to the slide mechanism when the drawer is at the intermediate position.

8. The assembly of claim 1, wherein the first end and the second end of the gas spring are positioned such that the change in gas spring compression is maximized with movement of the drawer approaching at least one of the fully closed position and the fully open position.

9. The assembly of claim 1, wherein the drawer is movable from at least one of the fully open position and the fully closed position toward the intermediate position by application of an external force against the drawer in a direction toward the intermediate position.

10. The assembly of claim 9, wherein the drawer is self-movable from the intermediate position toward at least one of the fully closed position and the fully open position after removal of the external force from the drawer.

11. The assembly of claim 1, wherein the first end of the gas spring is coupled to a mounting plate attached to the drawer slide mechanism.

12. The assembly of claim 1, the drawer rear panel further comprising at least two notched openings, one drawer support rail positioned within each of the notched openings of the rear panel.

13. A cabinet slide assembly comprising:

a cabinet comprising a floor, a roof, and a pair of side walls;

a drawer comprising a front panel, a rear panel, a pair of side panels coupling the front and rear panels, and a bottom panel attached to the front and rear panels, each drawer side panel having a lower surface and an inner surface, the inner surfaces of the side panels facing one another, the drawer rear panel having at least two notched openings;

at least one slide mechanism coupling the drawer to the cabinet and situated to permit movement of the drawer between a fully open position and a fully closed position, and through an intermediate position located therebetween, relative to the cabinet, the slide mechanism comprising a pair of drawer support rails coupled to the drawer side panels, one drawer support rail coupled to the inner surface of each of the drawer side panels, and one drawer support rail positioned within each of the notched openings, each drawer support rail having a lower surface; and a gas spring having a first end coupled to a portion of at least one of the cabinet and the slide mechanism, and a second end coupled to a portion of the drawer, wherein the gas spring is positioned below the drawer support rails in a space defined by the drawer bottom panel and the cabinet floor such that no portion of the gas spring crosses a plane defined by the lower surfaces of the drawer support rails, and adapted to self-extend from a compressed position to an extension position upon movement of the drawer from the intermediate position to at least one of the fully closed position and the fully open position.

14. The assembly of claim 13, wherein the gas spring is capable of swinging through an arc about the first end, with the second end being movable with the movement of the drawer.

15. The assembly of claim 13, wherein the gas spring is oriented within the mounting space such that the gas spring capable of swinging along a horizontal plane about the first end.

16. The assembly of claim 13, wherein the lower surfaces of the drawer support rails are positioned above the lower surfaces of the drawer side panels such that the drawer support rails are concealed from view when the drawer is in the fully open position and is viewed from a side thereof.

17. The assembly of claim 13, wherein the gas spring is adapted to facilitate a reduction of speed of the drawer as the drawer approaches at least one of the fully closed position and the fully open position.

18. A cabinet slide assembly comprising:

a cabinet;

a drawer;

a left drawer support rail and a right drawer support rail each coupled to the drawer, and a left supporting member and a right supporting member coupling the drawer support rails to the cabinet, the drawer support rails and supporting members situated to permit slidable movement of the drawer between a fully open position and a fully closed position, and through an intermediate position located therebetween, relative to the cabinet, the cabinet comprising walls defining a cavity for receiving the drawer, the drawer generally comprising a front panel, a rear panel having at least two notched openings each configured to receive a drawer support rail, a pair of side panels coupling the front and rear panels, and a bottom panel attached to the front and rear panels; and a gas spring having a first end coupled to a portion of the cabinet and a second end coupled to a portion of the drawer, wherein the drawer bottom is elevated from an interior surface of the cabinet to define a space along the drawer bottom and the gas spring is positioned within the space such that the gas spring is capable of swinging through an arc along a horizontal plane about the first end, with the second end being movable along a linear path with the movement of the drawer.

19. The assembly of claim 18, wherein the gas spring is adapted to exert an extension force, and is self-extendable from a compressed position to an extension position, upon movement of the drawer from the intermediate position to at least one of the fully closed position and the fully open position, wherein the gas spring is adapted to facilitate a reduction of speed of the drawer as the drawer approaches at least one of the fully closed position and the fully open position.

20. The assembly of claim 19, wherein the drawer is movable from at least one of the fully open position and the fully closed position toward the intermediate position by application of an external force against the drawer in a direction toward the intermediate position, and the drawer is self-movable from the intermediate position toward at least one of the fully closed position and the fully open position after removal of the external force from the drawer.

* * * * *